US007444989B2

(12) United States Patent
Shafer et al.

(10) Patent No.: US 7,444,989 B2
(45) Date of Patent: Nov. 4, 2008

(54) OPPOSED PUMPING LOAD HIGH PRESSURE COMMON RAIL FUEL PUMP

(75) Inventors: Scott F. Shafer, Morton, IL (US); Timur Trubnikov, Peoria, IL (US); William John Love V, Dunlap, IL (US); Heather Rebholz, Metamora, IL (US); Jianhua Zhang, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 27 days.

(21) Appl. No.: 11/604,579

(22) Filed: Nov. 27, 2006

(65) Prior Publication Data

US 2008/0121216 A1 May 29, 2008

(51) Int. Cl.
*F02M 57/02* (2006.01)
*F02M 37/04* (2006.01)
*F04B 1/04* (2006.01)

(52) U.S. Cl. ..... 123/446; 123/506; 417/273

(58) Field of Classification Search ..... 123/445–447, 123/495, 506, 455, 458; 417/473, 490, 493, 417/273

See application file for complete search history.

(56) References Cited

U.S. PATENT DOCUMENTS 2,423,701 A * 7/1947 Hardy ..... 417/273
2,697,403 A 12/1954 Benedek
3,596,568 A 8/1971 Wittren
3,682,572 A * 8/1972 Yarger ..... 417/273
3,975,990 A 8/1976 Kraus
4,709,673 A 12/1987 Babitzka
5,035,221 A * 7/1991 Martin ..... 123/451
5,109,822 A * 5/1992 Martin ..... 123/456
5,339,786 A 8/1994 Martin
5,701,873 A 12/1997 Schneider
5,848,879 A * 12/1998 Hansson ..... 417/521
5,876,186 A * 3/1999 Stiefel ..... 417/273
5,878,648 A 3/1999 Dworak
6,162,022 A * 12/2000 Anderson et al. ..... 417/213

(Continued)

FOREIGN PATENT DOCUMENTS

DE 1 503 356 1/1970

(Continued)

OTHER PUBLICATIONS

PCT International Search Report, PCT/US2007/022740, filed Oct. 26, 2007, Applicant: Caterpillar Inc.

*Primary Examiner*—Thomas N Moulis
(74) *Attorney, Agent, or Firm*—Liell & McNeil

(57) ABSTRACT

A high volume high pressure common rail pump for a fuel system includes pairs of pump head assemblies in phase with each other but oriented in opposition to one another about a rotating cam shaft. Pump pistons in the pump head assemblies simultaneously undergo pumping strokes via a shared two lobe cam of the rotating cam shaft. The pump may include two pairs of pump head assemblies, and each head assembly may include two pump pistons. The cam shaft includes two cams sufficiently out of phase with one another that the cam shaft always has a positive torque even when the cam lobes are symmetrical. In addition, because the pumping is done simultaneously on opposite sides of the cam shaft, the forces on the cam shaft are balanced and its support bearings experience less wear and tear.

20 Claims, 4 Drawing Sheets

U.S. PATENT DOCUMENTS

| | | | | |
|---|---|---|---|---|
| 6,216,583 | B1 | 4/2001 | Klinger et al. | |
| 6,345,609 | B1 * | 2/2002 | Djordjevic | 123/509 |
| 6,357,421 | B1 * | 3/2002 | Pritchard | 123/456 |
| 6,497,216 | B2 * | 12/2002 | Gaessler et al. | 123/450 |
| 6,615,799 | B2 * | 9/2003 | Mori et al. | 123/450 |
| 6,622,706 | B2 * | 9/2003 | Breeden | 123/495 |
| 6,694,950 | B2 * | 2/2004 | Djordjevic | 123/446 |
| 6,764,285 | B1 | 7/2004 | Kellner | |
| 6,814,548 | B2 * | 11/2004 | Sagnet | 417/273 |
| 6,843,641 | B1 | 1/2005 | Scharfenberg | |
| 7,281,519 | B2 * | 10/2007 | Schroeder et al. | 123/445 |
| 2001/0042436 | A1 * | 11/2001 | Pierrat | 91/491 |
| 2004/0136837 | A1 * | 7/2004 | Ganser et al. | 417/273 |

FOREIGN PATENT DOCUMENTS

| | | | |
|---|---|---|---|
| DE | 31 13737 | A1 | 10/1982 |
| EP | 1 201 913 | | 5/2002 |
| EP | 1 350 948 | | 10/2003 |

* cited by examiner

OPPOSED PUMPING LOAD HIGH PRESSURE COMMON RAIL FUEL PUMP

TECHNICAL FIELD

The present disclosure relates generally to high pressure pumps for fuel systems, and more particularly to pumps with pairs of pump assemblies oriented in opposition to one another for simultaneous pumping.

BACKGROUND

High pressure common rail fuel pumps for different engines have a variety of different characteristics suitable for their specific applications. Often times development of a new engine and associated fuel system can require a new pump design. Those skilled in the art will appreciate that designing, developing, testing, etc. a new pump can involve considerable expense. While this expense may be distributed over the expected number of engines, when volumes are relatively low, the per engine development cost can be relatively high. Unfortunately, there has often been no alternative since an off-the-shelf alternative is typically unable to meet, or be easily modified to meet, all of the specific requirements of the new fuel system application.

High pressure common rail pumps are typically driven via a rotating shaft coupled to the engine crank shaft via a gear train. Depending on the specific pump design, torque reversals can occur typically after a pumping stroke has concluded. Torque reversals are sometimes the result of the pumping chambers inherently having greater than zero volume at top dead center in conjunction with a cam lobe backside profile that allows the stored energy in the pressurized fuel remaining in the pumping chamber to push in a reverse direction on the cam shaft immediately after passing through top dead center. These torque reversals can produce unwanted stress in the gear train and cam shaft, as well as produce undesirable noise emissions.

In most common rail fuel pumps, such as those illustrated for example in U.S. Pat. Nos. 5,701,873, 6,216,583 and 6,764,285, the pump pistons and cams are arranged in such a way that the cam shaft undergoes repeated bending loads with each pumping stroke. These repeated loads over the life of the pump can cause significant wear on bearings supporting the cam shaft. Because common rail fuel pumps often raise fuel pressure to extremely high levels, and are expected to undergo many millions of pumping strokes in their useful life, bearings can prematurely wear and the cam shaft can suffer from cyclic fatigue loading. These factors can cause the pump to be overdesigned to compensate for these cyclic stresses, or can result in premature failure of a pump if these stress issues are not adequately taken into account. In either case, costs are undesirably increased.

The present disclosure is directed to solving one or more of the problems set forth above.

SUMMARY OF THE INVENTION

In one aspect, a pump assembly includes a rotatable cam shaft, which includes at least one cam, positioned in a pump housing. At least one pair of electronically controlled pump head assemblies are attached to the housing. Each pair of pump head assemblies includes a first pump head assembly oriented opposite to, sharing at least one common cam with and being in phase with a second pump head assembly.

In another aspect, a method of pressurizing fuel includes rotating a cam shaft in a pump housing. Pump pistons are moved on opposite sides of the cam shaft with a common cam in simultaneous pumping strokes. High pressure output from pumping chambers associated with the respective pump pistons is metered with electrical actuators associated with the respective pump pistons.

In still another aspect, a fuel system includes a pump with a rotatable cam shaft positioned in a pump housing. The pump includes at least one pair of electronically controlled pump head assemblies attached to the pump housing on opposite sides of the cam shaft, sharing at least one common cam of the cam shaft and being in phase with each other. A common rail is fluidly connected to the pump. A plurality of fuel injectors are fluidly connected to the common rail.

DETAILED DESCRIPTION

Figure 1:
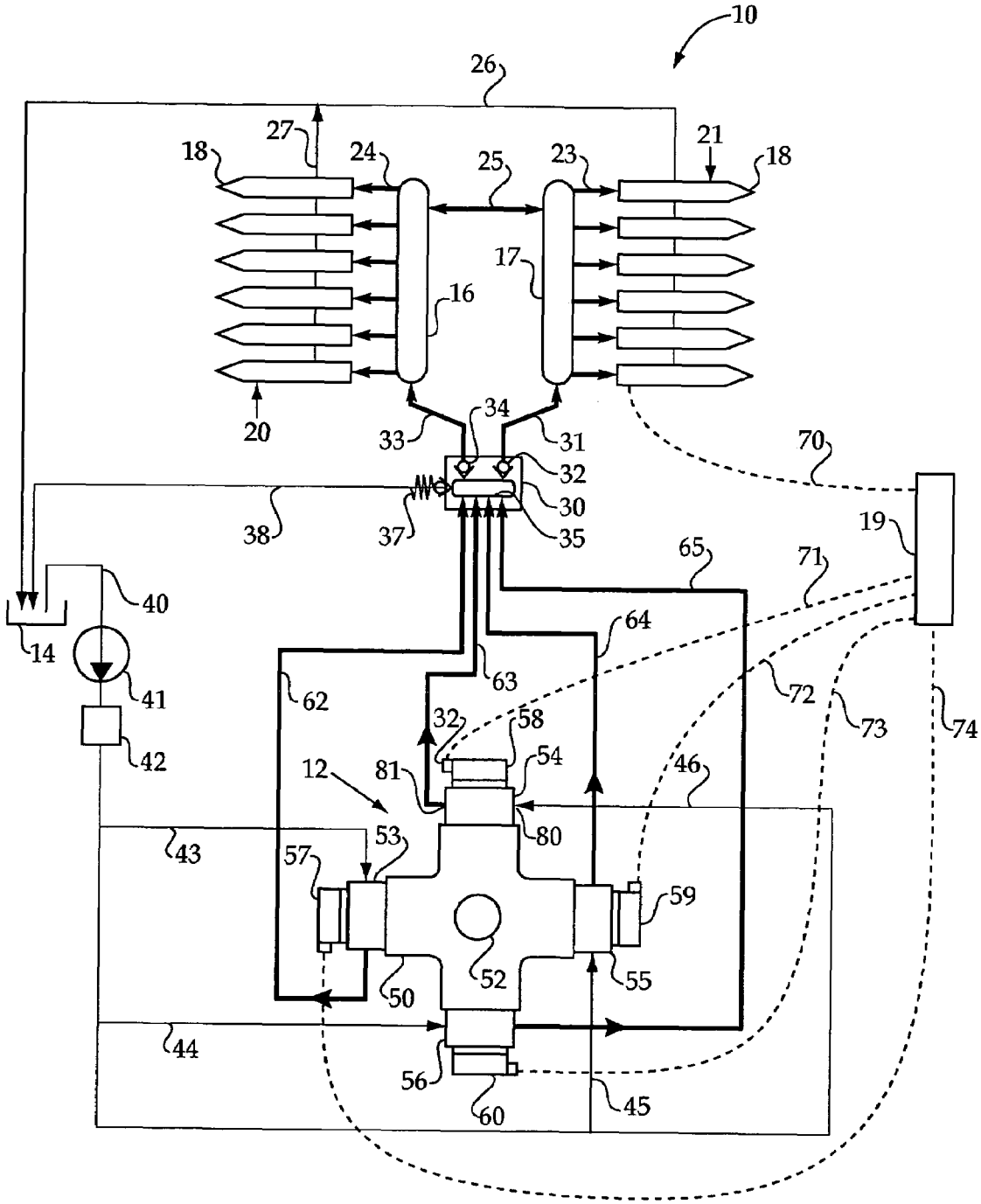
FIG. 1 is a schematic view of a fuel system according to the present disclosure.

Referring to FIG. 1, a common rail fuel system 10 includes a high pressure fuel pump 12, a low pressure fuel supply reservoir 14, common rails 16 and 17, and a plurality of fuel injectors 18. In the illustrated embodiment, fuel injectors 18 are distributed in a left bank 20 and a right bank 21 that utilize respective common rails 16 and 17, which are in fluid communication with one another in a known manner via pressure communication passage 25. Thus, fuel system 10 is configured for a V-type engine having 12 cylinders that each include a fuel injector 18 positioned for direct injection of fuel into the individual cylinders. Nevertheless, those skilled in the art will appreciate that the present disclosure is applicable to any engine configuration with any number of cylinders. However, the present disclosure is particularly applicable to large engines with many cylinders and a large fuel consumption demand.

Each of the individual fuel injectors 18 is electronically controlled by an engine controller 19 via communication lines 70 (only one shown) in a manner well known in the art. The fuel injectors 18 each are fluidly connected to common rails 16 and 17 via branch passages 24 and 23, respectively. In addition, depending upon the particular structure of fuel injector 18, they may include drain passages 26 and 27 that return low pressure fuel to fuel reservoir 14 in a known manner. For instance, some fuel injectors consume some pressurized fuel to perform control functions relating to injection quantity, and that fuel is returned to the low pressure reservoir 14 for recirculation.

Common rails 16 and 17 are supplied with high pressure fuel from a gallery 35 of an accumulation block 30 via rail supply passages 33 and 31 respectively. Back flow of fuel from common rails 16 and 17 toward accumulation block 30 is prevented by respective check valves 34 and 32. If desired, accumulation block 30 may include a pressure relief valve 37 that opens to channel fluid back to low pressure reservoir 14 via return passage 38 in the event that pressure in gallery 35 exceeds some predetermined threshold. Normally, pressure relief valve 37 will remain closed.

Gallery 35 of accumulation block 30 is supplied with high pressure fuel via four separate high pressure output lines 62, 63, 64 and 65 from pump 50. Each of the high pressure output lines 62-65 is fluidly connected to a high pressure outlet 81 (FIG. 3) of one of the pump head assemblies 53, 54, 55 and 56 that are included as part of pump 12. Electronically controlled pump head assemblies 53-56 are arranged in pairs 54, 56 and 55, 57 on opposite sides of cam shaft 52, which rotates within the pump housing 50. Each of the pump head assemblies 53-56 are preferably substantially identical, and the present disclosure contemplates the individual pump head assemblies 53-56 being based upon a pump head assembly for a smaller engine that includes a common rail pump with only a single pump head assembly. Thus, the present disclosure contemplates a larger capacity pump that draws upon proven experience gained, and design and testing time expended, creating a pump assembly for a smaller engine that includes only one pump head assembly. Nevertheless, those skilled in the art will appreciate that the pump head assemblies 53-56 could be unique to pump 12 rather than drawing upon design experience gained with a single pump head assembly pump. In this case, the individual pump head assemblies 53-56 may be substantially identical to single pump head assemblies associated with a Caterpillar CR-350 common rail pump typically associated with a smaller engine with less fuel consumption demand. The output from the individual pump head assemblies 53-56 is controlled by separate communication lines 71, 72, 73 and 75 via engine controller 19. The control communication lines 71-74 are connected to respective communication line sockets 82 associated with individual electrical actuators 57, 58, 59 and 60, respectively, that are part of the individual pump head assemblies 53-56.

The lower pressure side of fuel system 10 includes a supply passage 40 that draws low pressure fuel from fuel supply reservoir 14 and circulates the fuel to high pressure pump 12 via a fuel transfer pump 41. Downstream from fuel transfer pump 41, the fuel may be filtered in a conventional manner via filter 42 and branches into separate supply passages 43, 44, 45 and 46 that individually connect to different low pressure inlets 80 of the individual pump head assemblies 53-56.

Figure 2:
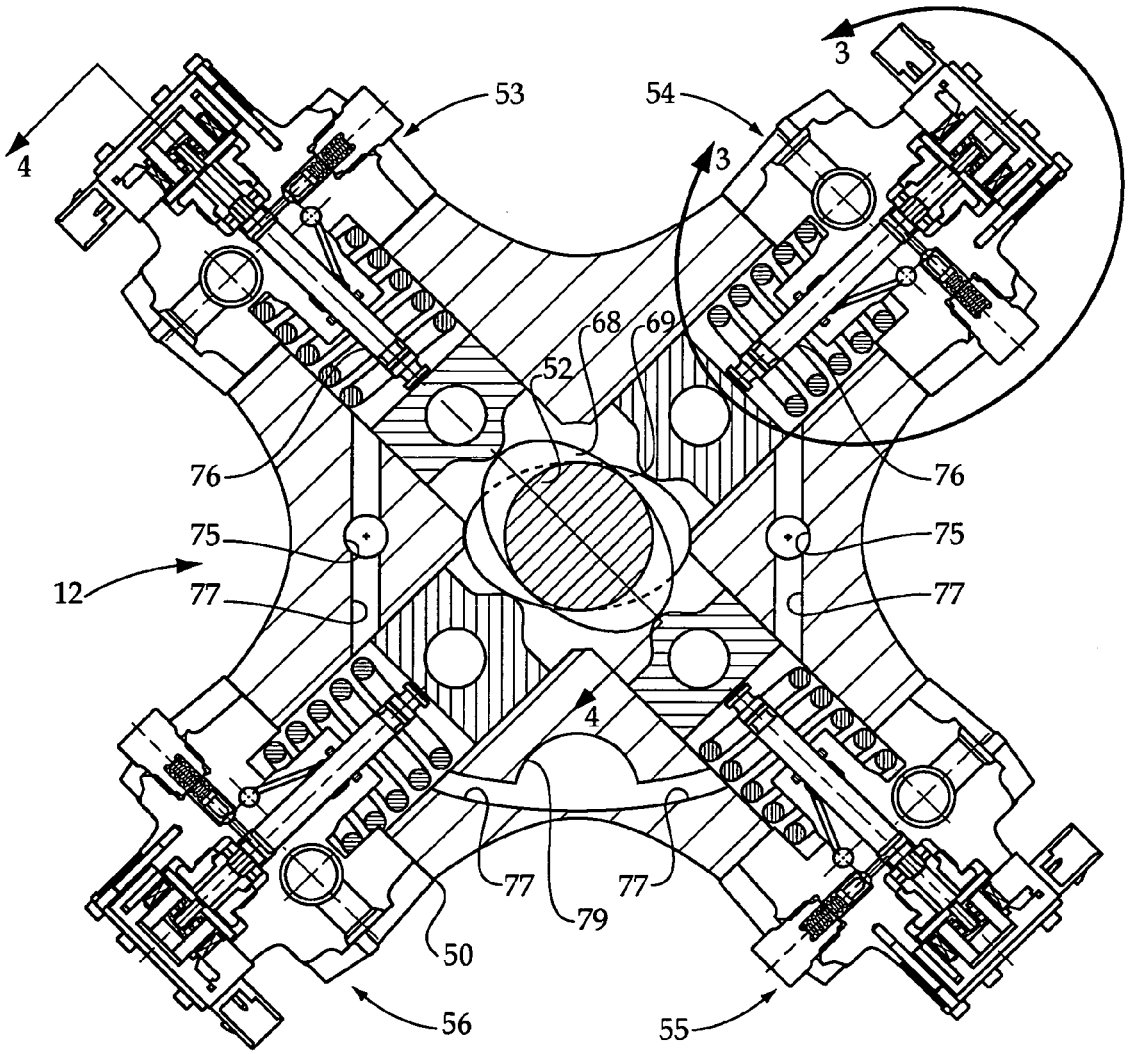
FIG. 2 is a sectioned side view of the pump for the fuel system of FIG. 1.
Figure 3:
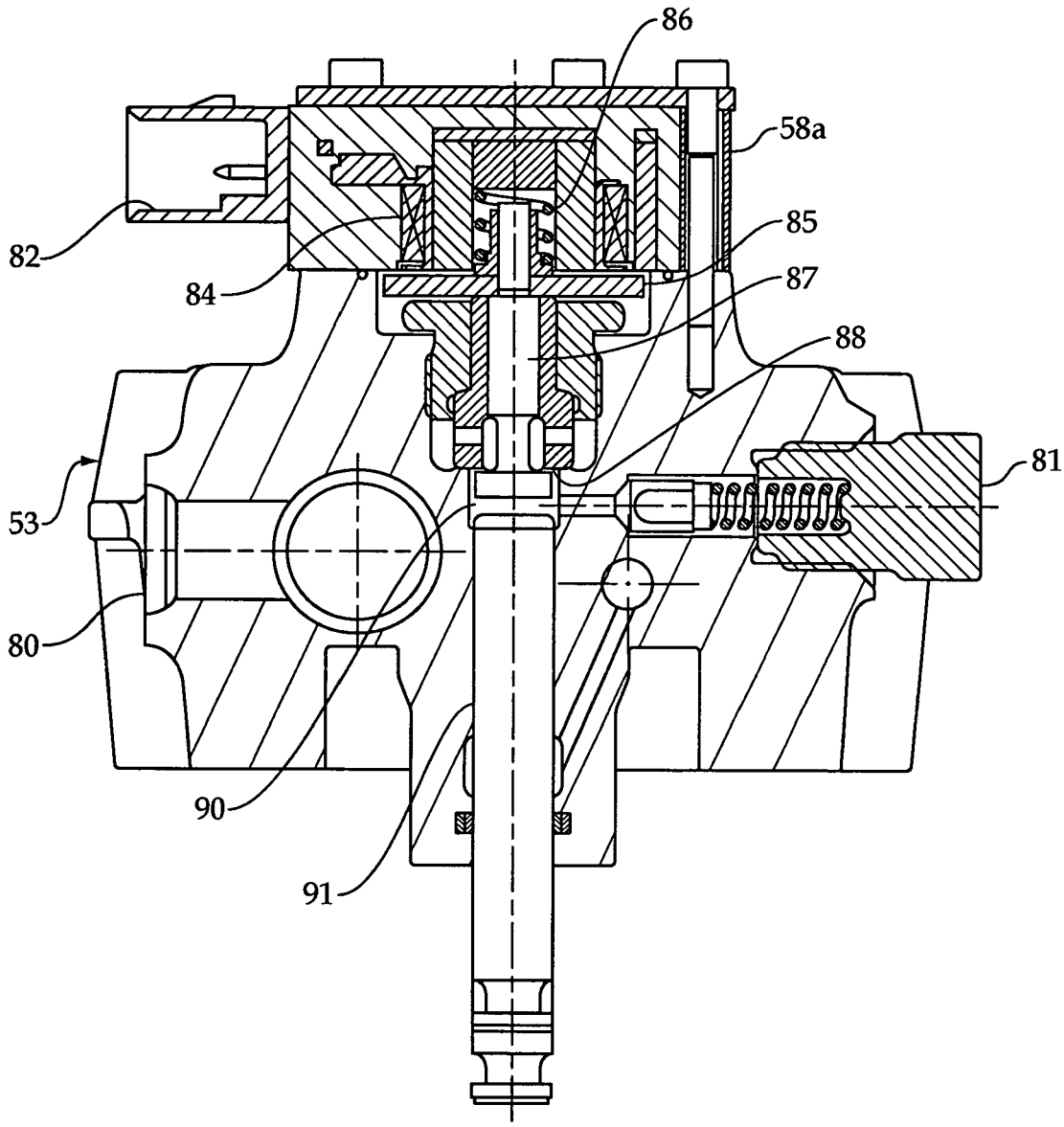
FIG. 3 is an enlarged sectioned view of one pump head assembly from the pump of FIG. 2.

Referring now to FIGS. 2 and 3, the lifters 76 of the individual pump head assemblies 53-56 are lubricated via a common lubrication supply passage 75 that connects to lubrication passage 77. Lubrication circulation passage 77 empties into lubrication sump 79, which is preferably positioned lower than all of the four lifters 76 to avoid any potential hydraulic locking. The accumulated lubrication fluid in sump 79 is returned for recirculation in a conventional manner.

FIG. 2 is also noteworthy for showing that cam shaft 52 includes a first cam 68 that includes a pair of cam lobes oriented 180° apart, and a second similar cam 69 located at a second location along the length of cam shaft 52. The lobes of cams 68 and 69 may be symmetrical, but need not be. In the illustrated embodiment, cams 68 and 69 are out of phase with one another sufficient to prevent cam shaft 52, and its associated gear train, from experiencing torque reversals. In the illustrated embodiment, this may be accomplished by orienting cams 68 and 69 out of phase with one another by 45°, as shown.

Figure 4:
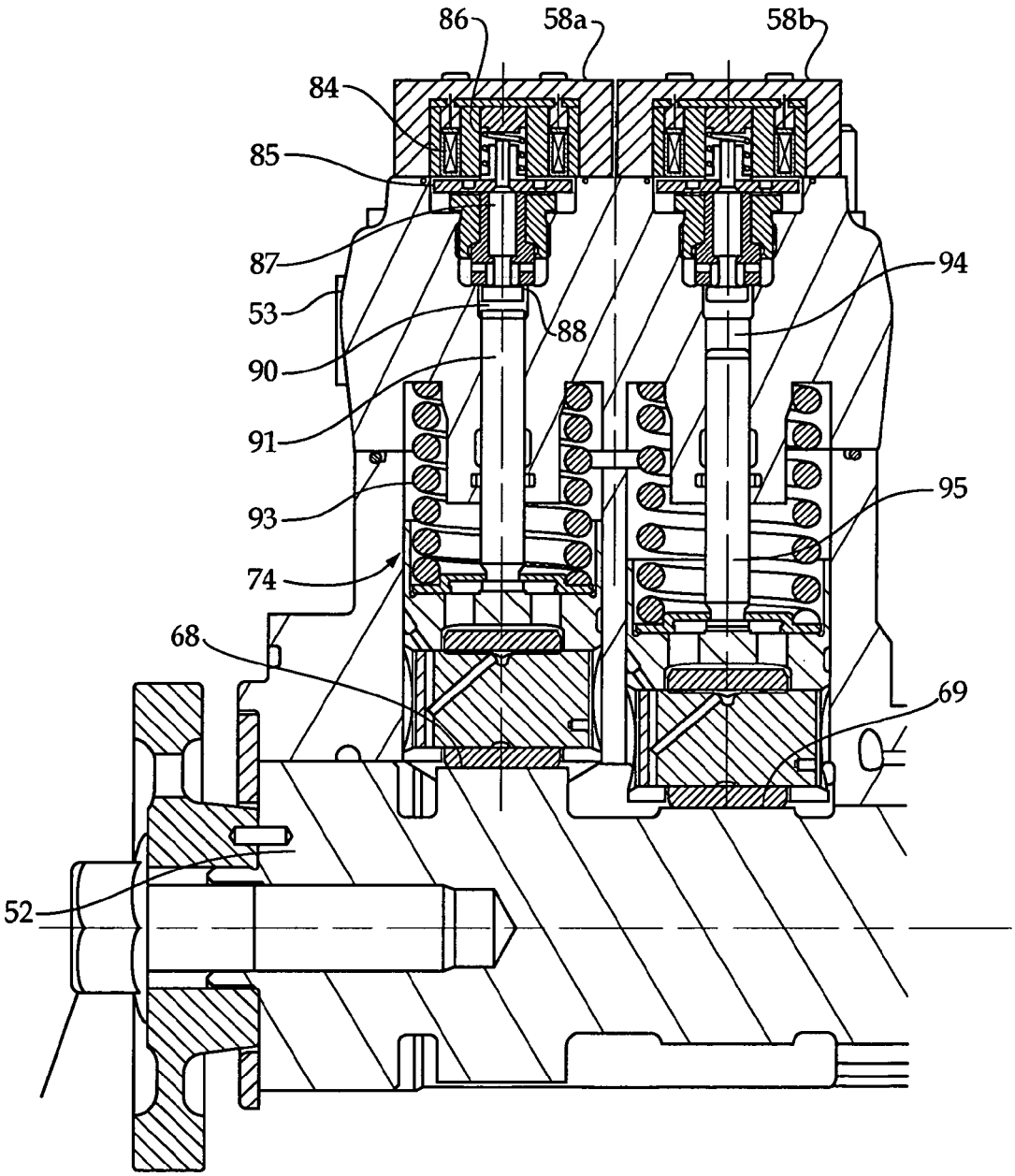
FIG. 4 is a sectioned view along section lines 3-3 of FIG. 1 of one of the pump head assemblies according to the present disclosure.

Referring now in addition to FIG. 4, each of the pump head assemblies 53-56 includes a pair of pumping chambers 90 and 94 associated with individual pump pistons 91 and 95, respectively. One of the pump pistons 91 is operably coupled to move with rotation of cam 68, while the other pump piston 95 is coupled to move with rotation of cam 69. Thus, each pump piston undergoes two pumping strokes with each revolution of cam shaft 52. A biasing spring 93 associated with each of the pump pistons maintains the pump piston in following contact with its individual cam in a manner well known in the art. Each of the pump pistons 91 and 95 has associated therewith an individual electrical actuator 58*a* and 58*b* that controls high pressure fluid output from the respective pumping chambers 90 and 94. The electrical actuators associated with pump pistons on opposite sides of cam shaft 52 that are undergoing simultaneous pumping strokes may be on the same electrical circuit and connected in series or parallel so that their respective electrical actuators will be simultaneously energized with one electrical circuit. Alternatively, each of the electrical actuators of pump 12 may be on a separate electrical circuit, and the engine controller 19 would include logic capable of simultaneously energizing different pairs of circuits to achieve the same end. The latter may be more desirable when considerations of potential failure modes are brought to bear on design considerations. Thus, each of the pump head assemblies 53-56 includes two electrical actuators, for a total of eight electrical actuators and eight pumping pistons associated with four pump head assemblies 53-56.

Each of the electrical actuators 58*a*, is associated with a solenoid coil 84 that, when energized, is coupled magnetically to an armature 85, which is attached to a valve member 87. In this case, valve member 87 is a latching type valve that moves into and out of pumping chamber 80 with respect to a seat 88. Armature 85 and hence valve member 87 are biased toward an open position by a biasing spring 86. Thus, during a pumping stroke of pump piston 91, fluid will be circulated to a low pressure portion of the pump past seat 88 while valve member 87 is open. When it is desirable to create high pressure output, coil 84 is briefly energized to pull armature 85 and valve member 87 upward to close seat 88 during a pumping stroke. Thereafter, for the remainder of the pumping stroke, the coil 84 can be de-energized, and the high pressure in pumping chamber 90 will maintain valve member 87 in a closed position. The high pressure fluid produced in the pumping chamber is channeled toward an outlet 81 via passages not shown.

INDUSTRIAL APPLICABILITY

The present disclosure finds potential use in any high pressure pumping application that includes a need to control output from the pump. The present disclosure finds particular application in the field of high pressure pumps for common rail fuel systems, especially those with a relatively high fuel consumption demand. The present disclosure also teaches potential solutions to relieving bending fatigue on a pump cam shaft or balancing forces on the cam shaft to alleviate excessive wear and tear on bearings supporting the rotating cam shaft. Finally, the present disclosure also finds potential use in any pumping application where potential torque reversals can be of concern as producing excessive noise in the gear train coupled to the pump cam shaft. The present disclosure also finds potential application in cases where proven experience and reliability in relation to a lower flow pump with a single pump head assembly can be exploited to make a much large flow volume pump with multiple pump head assemblies substantially identical to the lower flow pump. In the illustrated example the pump described leverages experience gained in relation to the Caterpillar CR-350 pump with a single pump head assembly to make a large flow pump that utilizes four such pump head assemblies arranged in opposed pairs about the cam shaft.

Those skilled in the art will appreciate that with the dual lobe cams 68 and 69, and the distribution of pump head assembly around the pump housing 50, each of the eight pump pistons will undergo two pumping strokes during each revolution of cam shaft 52. These pumping strokes will occur over about 90° of cam shaft's 52 rotation, and the pumping pistons will undergo a retraction stroke for about 90° between each pumping stroke. By utilizing dual lobed cams with lobes 180° apart, different pairs of pumping pistons undergo simultaneous in phase pumping strokes on opposite sides of cam shaft 52. Thus, this fact can be exploited to reduce cyclic bending loads and the associated wear on bearings since the balanced forces on the cam shaft are from opposite sides of the cam shaft substantially eliminates bending loads.

The cams 68 and 69 are preferably out of phase with one another sufficiently to prevent torque reversals when the pump 12 is in operation. This is accomplished in the illustrated embodiment by orienting cams 68 and 69 45° out of phase with one another so that when any of pistons passes through their top dead centers, another pair of pump pistons will be in the middle of their pump strokes. Thus, provided that the pump is operating at least 50% capacity, fuel will be pressurized in different pairs of pumping chambers at all times throughout the revolution of cam shaft 52. Thus, no torque reversals will occur when the engine controller 19 is requesting at least 50% of each pumping stroke as high pressure output. Recalling, that pump output is controlled by briefly energizing the electrical actuator and closing the spill valve associated with the specific pump piston at any time during its pumping stroke. Thus, energizing the electrical actuator at the beginning of a pumping stroke will produce near 100% output from that respective pumping chamber, whereas leaving that electrical actuator unenergized throughout that pump piston's pumping stroke will produce zero high pressure output.

When the desired high pressure pump output drops below about 50%, different control strategies can be utilized to either avoid torque reversals and its associated noise or by avoiding bending forces on the cam shaft, but typically not both. In the first instance, when the pump is operating at a lower range such as at 25-50% output, the various electrical actuators can be energized in a way that only one pump head assembly is producing output at a time. Thus, while two pump pistons may be undergoing simultaneous pumping strokes, only the electrical actuator associated with one of the pump pistons may be energized during the pumping stroke to produce output. By operating the pump in this manner, a positive torque can still be maintained on cam shaft 52 throughout its revolution, but forces on the cam shaft will no longer be balanced at this lower output range. It may not be possible to avoid all torque reversals with the illustrated pump when the desired output is very low. In other words, no combination of energizing various actuators may permit continuos positive torque on the cam shaft 52 when desired output is extremely low and the cam lobes are symmetrical. On the other hand, if avoiding bending forces on cam shaft 52 is of more importance than avoiding torque reversals, the pump can be controlled when operating at a less than 50% capacity using the same strategy as that associated with that discussed above with regard to larger outputs in excess of 50% capacity. Thus, if bending stress is of greater concern than torque reversals, simultaneous pumping of pump pistons on opposite sides of the cam shaft 52 will continue across the entire output range of pump 12.

Although the illustrated pump 12 includes two pairs of oppositely oriented pump head assemblies 53-56 attached to a single pump housing, in a common plane, the pump head assemblies may not necessarily need to be in a common plane. For instance, an alternative design could have each pair of pump head assemblies in a common plane, such that a first pair of pump head assemblies would be in a forward plane and a second pair of pump head assemblies could be in a back plane. In addition, although the present disclosure illustrates a pump whose output is controlled via spill control, the present disclosure also contemplates potential application to inlet metered pump designs. Those skilled in the art will appreciate that inlet metering restricts the amount of liquid that enters the pump chamber to the desired volume of output liquid from that pumping chamber for its pumping stroke. Although the illustrated pump includes two pairs of pump head assemblies 53-56, the present disclosure also contemplates a pump with a single pair of pump head assemblies or three or more pairs of pump head assemblies without departing from the intended scope of the present disclosure. It is this aspect of the present disclosure that allows leveraging of proven experience with a pump having a single pump head assembly to be carried forward into a larger volume pump having a plurality of the proven pump head assemblies arranged according to the teachings of the present disclosure. By appropriately selecting the number of pump head assemblies for the expected flow demand of the pumping application and arranging the pump head assemblies around the cam shaft in the way illustrated, a pump can be produced that avoids torque reversals and associated noise over a majority or all of its expected duty cycle, and avoids bending forces on the cam shaft and the associated wear and tear on support bearings by exploiting balanced forces from opposite sides of the cam shaft. The present disclosure also presents the opportunity of scaling a single head pump head assembly into larger flow demand situations across a potential product line so that economies of scale can be brought to bear substantially reducing costs and part variation among different engine applications.

It should be understood that the above description is intended for illustrative purposes only, and is not intended to limit the scope of the present invention in any way. Thus, those skilled in the art will appreciate that other aspects of the invention can be obtained from a study of the drawings, the disclosure and the appended claims.

What is claimed is:

1. A pump assembly comprising:

a pump housing;

a rotatable cam shaft, which includes at least one cam, positioned in the pump housing;

at least one pair of electronically controlled pump head assemblies attached to the pump housing; and each pair of pump head assemblies includes a first pump head assembly oriented opposite to, sharing at least one common cam with and being in phase with, a second pump head assembly.

2. The pump assembly of claim 1 wherein the cam shaft includes a first cam and a second cam out of phase with the first cam; and each pump head assembly includes a first pump piston coupled to the first cam and a second pump piston coupled to the second cam.

3. The pump assembly of claim 2 including two pairs of electronically controlled pump head assemblies; and each pump head assembly includes a first pump piston coupled to the first cam and a second pump piston coupled to the second cam.

4. The pump assembly of claim 3 wherein each of the first and second cams includes a pair of lobes oriented 180 degrees apart.

5. The pump assembly of claim 4 wherein the second cam is sufficiently out of phase with the first cam to maintain positive torque on the cam shaft when the cam shaft is rotating.

6. The pump assembly of claim 5 wherein the second cam is 45 degrees out of phase with the first cam.

7. The pump assembly of claim 5 wherein each pump assembly includes a first electrical actuator for controlling output associated with the first pump piston, and a second electrical actuator for controlling output associated with the second pump piston.

8. The pump assembly of claim 5 wherein the pump housing includes a lubrication passageway therein that is shared in common with all of the pump head assemblies.

9. A method of pressurizing fuel, comprising the steps of:

rotating a cam shaft in a pump housing;

moving pump pistons on opposite sides of the cam shaft with a common cam in simultaneous pumping strokes; and metering high pressure output from pumping chambers associated with the respective pump pistons with electrical actuators associated with the respective pump pistons.

10. The method of claim 9 wherein the metering step includes closing spill valves for the respective pumping chambers with the respective electrical actuators.

11. The method of claim 10 including a step of maintaining a positive torque on the cam shaft throughout each revolution.

12. The method of claim 11 wherein the maintaining step includes reciprocating each of eight pump pistons twice with each revolution of the cam shaft.

13. The method of claim 12 wherein a first four of the eight pump pistons share a first common cam; and a second four of the eight pump pistons share a second common cam; and the maintaining step includes orienting the second common cam about 45 degrees out of phase with the first common cam.

14. The method of claim 13 including a step of lubricating lifters for the pump pistons via a shared lubrication passageway in the pump housing.

15. A fuel system comprising:

a pump including a rotatable cam shaft positioned in a pump housing, and at least one pair of electronically controlled pump head assemblies attached to the pump housing on opposite sides of the cam shaft, sharing at least one common cam of the cam shaft, and being in phase with each other;

a common rail fluidly connected to the pump; and a plurality of fuel injectors fluidly connected to the common rail.

16. The fuel system of claim 15 including a pump controller in control communication with each of the electronically controlled pump head assemblies.

17. The fuel system of claim 16 including two pair of electronically controlled pump head assemblies.

18. The fuel system of claim 17 wherein the cam shaft includes first and second cams shared in common with each of the electronically controlled pump head assemblies.

19. The fuel system of claim 18 wherein each of the first and second cams includes a pair of lobes oriented 180 degrees apart.

20. The fuel system of claim 19 wherein the second cam is sufficiently out of phase with the first cam to maintain positive torque on the cam shaft when the cam shaft is rotating.

* * * * *